US005542897A

United States Patent [19]

Hall

[11] Patent Number: 5,542,897

[45] Date of Patent: Aug. 6, 1996

[54] EXERCISE PUMP DEVICE

[76] Inventor: Timothy L. Hall, 3209 Sherman Rd., Oconto, Wis. 54154

[21] Appl. No.: 373,963

[22] Filed: Jan. 17, 1995

[51] Int. Cl.[6] ..... A63B 21/00

[52] U.S. Cl. ..... 482/111; 482/93; 601/23

[58] Field of Search ..... 482/111, 112, 482/148, 44, 93, 97, 113; 434/247; 601/23, 33, 40

[56] References Cited

U.S. PATENT DOCUMENTS 4,471,957 9/1984 Engelitcheff ..... 482/112

4,979,735 12/1990 Stewart ..... 482/111

5,000,440 3/1991 Lynch ..... 482/112

*Primary Examiner*—Stephen R. Crow

*Attorney, Agent, or Firm*—Godfrey & Kahn, S.C.

[57] ABSTRACT

A purposeful exercise device including a frame; a pump mounted on the frame; and a work-adjusting mechanism movably borne by the frame and disposed in force-transmitting relation relative to the pump. The pump has a handle which is moveable along a path of travel from a first or fluid withdrawing position to a second or fluid exhausting position. The work-adjusting mechanism permits a patient or operator to selectively adjust the amount of work performed when moving the pump handle from the fluid withdrawing position to the fluid exhausting position or vice versa.

19 Claims, 7 Drawing Sheets

EXERCISE PUMP DEVICE

BACKGROUND OF THE INVENTION

1. Field of the Invention

The present invention relates to an exercise and rehabilitation device. More particularly, the present invention relates to an exercise and rehabilitation device that is particularly well suited for providing a purposeful activity to a patient who is undergoing occupational therapy and rehabilitation.

2. Description of the Prior Art

The goals of occupational therapy are to direct participation in selected tasks to restore, reenforce and enhance physical performance; facilitate learning of skills and functions essential for adaptation and productivity; diminish or correct pathology; and to promote and maintain health. It is known in the art that purposeful activity facilitates the achievement of these goals. In this regard, occupational therapy is based on the belief that purposeful activity, including its interpersonal and environmental components, may be used to prevent and mediate dysfunction, and to elicit maximum adaptation. Purposeful activity is normally viewed as any task or experience in which a patient actively participates, and which the patient achieves a goal beyond mere exercise. By selecting activities in which the patient has an interest, an occupational or physical therapist assumes that the patient will experience enough satisfaction to sustain performance. Each successful effort elicited by the therapist serves as an incentive for greater effort by the patient. In other words, purposeful activity provides an intrinsic motivation to act.

It is the belief of occupational therapists that a patient undergoing occupational therapy who is provided with interest-sustaining activities is likely to pursue those activities longer than would be expected with less interesting activities or exercises. In addition, it is known that the heart rate of a patient exercising at a predefined level of perceived exertion is significantly higher in the performance of a purposeful activity than in the performance of a nonpurposeful activity. The suggestion of this information is that individuals may not perceive fatigue as readily when the focus of their attention is on the end product, or purpose of the activity, rather than on the act itself. It has also been shown that patients performing a purposeful activity perform a significantly greater number of repetitions during a purposeful activity than during a nonpurposeful activity.

The above principles have been embodied in some prior-art exercise and rehabilitation devices. For example, one form of a purposeful activity exercise device is a rehabilitation woodworking machine requiring reciprocal pedaling to operate an integral drill press. Such a device includes a cycle ergometer; a platform serving as a drill press work table; and a pedal powered drill press mounted on top of the work table. The purposeful activity involved in such a woodworking rehabilitation device includes drilling a series of holes in wood blanks to construct a board game. The longer a patient is able to sustain pedaling the more time the patient has to construct board games. As should be understood, the purposeful activity of constructing the board game provides an intrinsic motivation to the patient, that is, a patient using the woodworking rehabilitation device will tend to exercise for a longer period of time than if the patient was using a nonpurposeful exercise device, such as, for example, an exercise bicycle.

There are, of course, numerous and varied prior-art exercise devices. One such device is found in U.S. Pat. No. 4,772,015 ("the '015 patent"), which issued to Carlson et al. In this regard, the '015 patent describes a shoulder and arm exercise machine having a base; a resistance unit operatively connected to the base; an exercise arm extending from the resistance unit; and a handgrip assembly slidably mounted on the exercise arm. The exercise device disclosed in the '015 patent provides a means for carrying out a variety of shoulder and elbow exercise movements.

While many of the prior-art devices have operated with varying degrees of success, and have proven capable of providing exercise and rehabilitation for various muscle groups of the body, these devices have also proven to be less than ideal and sometimes ineffective for various reasons. For example, devices such as those described in the '015 patent to Carlson et al. do not necessarily provide a purposeful activity to patients and, therefore, do not provide the benefits of a purposeful activity exercise device, namely intrinsic motivation which leads to increased exercise time, cardiovascular conditioning, and muscular rehabilitation. Further, devices such as the woodworking rehabilitation device discussed above provide exercise and rehabilitation to limited portions of a patient's body. Moreover, the woodworking exercise machine described above is less than ideal because the device requires the use of relatively expensive, nonreusable material, in particular, wood blanks. It also requires the use of a possibly dangerous device, in particular, a drill press, and produces a byproduct, sawdust, which is created by the drill press, and which must be cleaned periodically from the device and removed from the exercise area.

Therefore, it has long been known that it would be desirable to have an exercise and rehabilitation device that incorporates the principles of purposeful activity while providing exercise and rehabilitation to various muscle groups of the body without the need of utilizing nonreusable, and relatively expensive material and without further the need of removing and cleaning byproducts produced by the purposeful exercise. It would also be desirable to have a purposeful exercise and rehabilitation device that provides exercise and rehabilitation for a patient's shoulders, arms, and elbows. It would also be desirable to have a purposeful exercise device that provides exercises for major muscle groups which facilitates in the ambulation of the patient with a walker or a cane; rising from or propelling a wheelchair; and for using railings or grab bars for mobility and safety. It would be even more desirable to have a purposeful exercise device which in addition to exercising the muscle groups involved in the above activities, i.e., shoulder and elbow flexors and extensors; and shoulder adductors and abductors; exercised proximal muscles in the back and abdomen. It would also be desirable to have a purposeful exercise device that is adjustable so that the patient may stand or sit while exercising according to the needs, tolerance, and stamina of the patient. It would also be desirable to have a purposeful exercise device where the activity performed by the patient is measurable so that the progress the patient makes can be readily recorded.

OBJECTS AND SUMMARY OF THE INVENTION

Therefore, it is an object of the present invention to provide an improved purposeful exercise device for use by a patient undergoing occupational therapy and rehabilitation.

A further object of the present invention is to provide a purposeful exercise device and wherein various muscle groups of the body may be exercised and wherein the exercise device utilizes inexpensive extrinsic materials.

A further object of the present invention is to provide a purposeful exercise device which does not produce a byproduct.

A further object of the present invention is to provide a purposeful exercise device for exercising and rehabilitating a patient's shoulders, arms, and elbows.

A further object of the present invention is to provide a purposeful exercise device for exercising major muscle groups which are important in ambulating with a walker or cane; rising from or propelling a wheelchair; and using railings or grab bars for mobility and safety.

A further object of the present invention is to provide a purposeful exercise device for exercising the proximal muscles in the back and abdomen and which are utilized to stabilize the trunk of the patient using the purposeful exercise device.

A further object of the present invention is to provide a purposeful exercise device that is adjustable so that the subject may stand or sit while exercising according to the personal needs, tolerance, and stamina of the patient.

A further object of the present invention is to provide a purposeful exercise device and wherein the purposeful activity performed by the patient is measurable so that the progress the patient makes can be readily recorded.

These and other objects and advantages are achieved in a purposeful exercise device of the present invention which includes a frame; a pump mounted on the frame; and a work-adjusting mechanism movably borne by the frame and disposed in force-transmitting relation relative to the pump. The pump includes a handle for manually operating same, and is moveable along a path of travel from a first, or fluid withdrawing position, to a second, or fluid exhausting position. The work adjusting mechanism permits selective adjustment of the amount of work performed by the operator when moving the pump handle from the fluid withdrawing position, to the fluid exhausting position.

The exercise device of the present invention may include a fluid reservoir and a fluid tube having a first end and a second end, and wherein the first end of the fluid tube is connected in fluid transmitting relation relative to the pump, and the second end of the fluid tube is positioned in fluid withdrawing relation relative to the fluid reservoir. The fluid tube is connected to the pump in a manner so as to facilitate the pumping of fluid from the reservoir and through the pump, when a patient manually operates the pump handle. Optionally, a bucket or other container may be suspended from or otherwise connected on the pump so that a patient may successively fill the bucket or container with fluid.

The exercise device of the present invention may include a locking mechanism for selectively securing the pump in a predetermined position relative to the frame. The exercise device of the present invention may also include a counterbalancing mechanism which is borne by the frame and connected in force transmitting relation relative to the pump. Additionally, a progress display assembly such as, for example, a chalkboard or electronic display, may be mounted on the frame of the exercise device.

These and other objects and advantages of the present invention will become more apparent from the following detailed description of the preferred embodiment of the present invention taken in combination with the accompanying drawings.

DESCRIPTION OF THE PREFERRED EMBODIMENT

Figure 1:
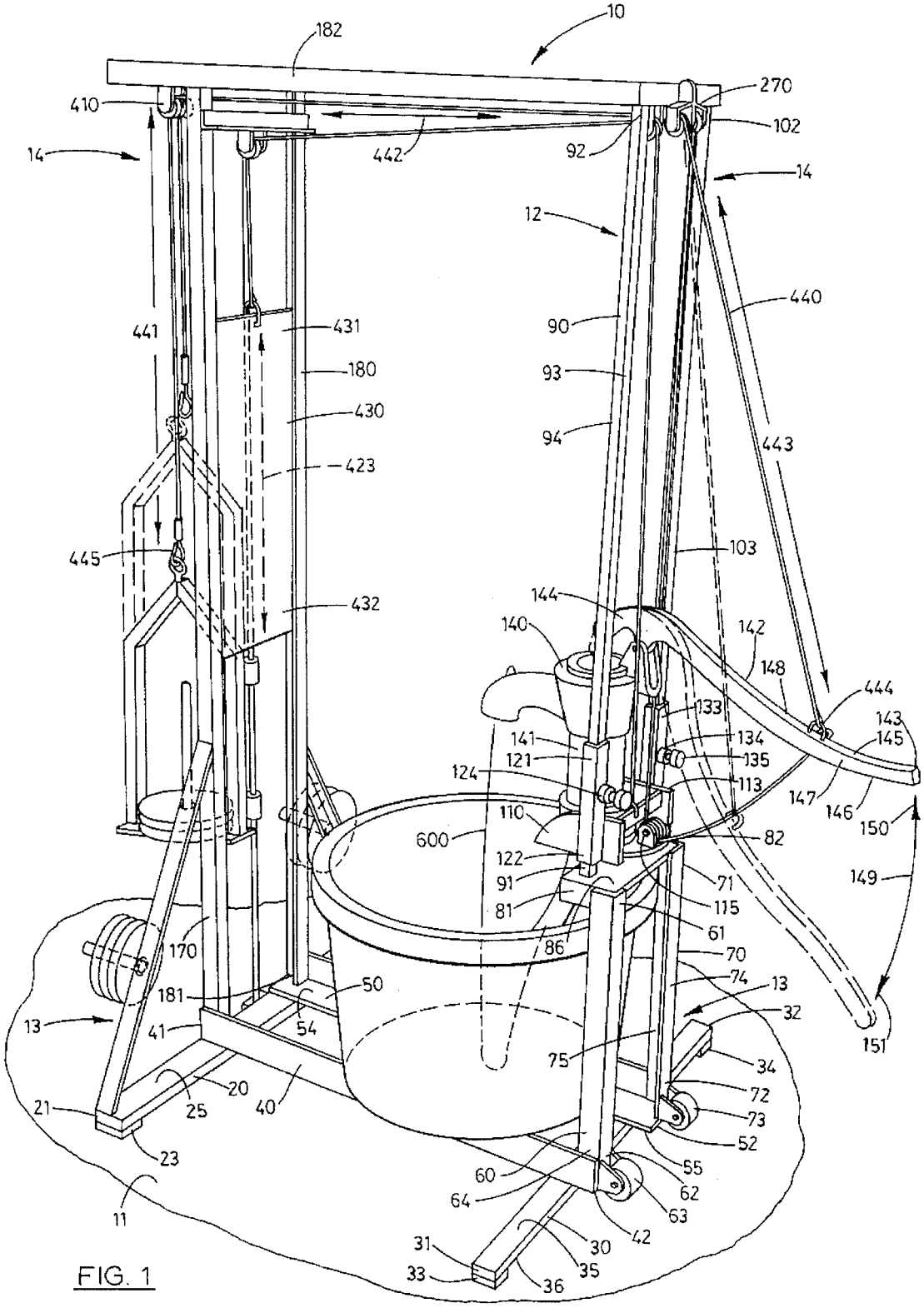
FIG. 1 is a first, perspective, front elevation view of the exercise device of the present invention and showing the pump handle in solid lines in a first raised position, and in phantom lines in a second, lowered position.

Referring more particularly to the drawings, the purposeful exercise device of the present invention is designated generally by the numeral 10 in FIG. 1. The exercise device 10 is adapted to rest on a supporting surface 11, such as a floor or the like, and includes a frame designated generally by the numeral 12.

Figure 3:
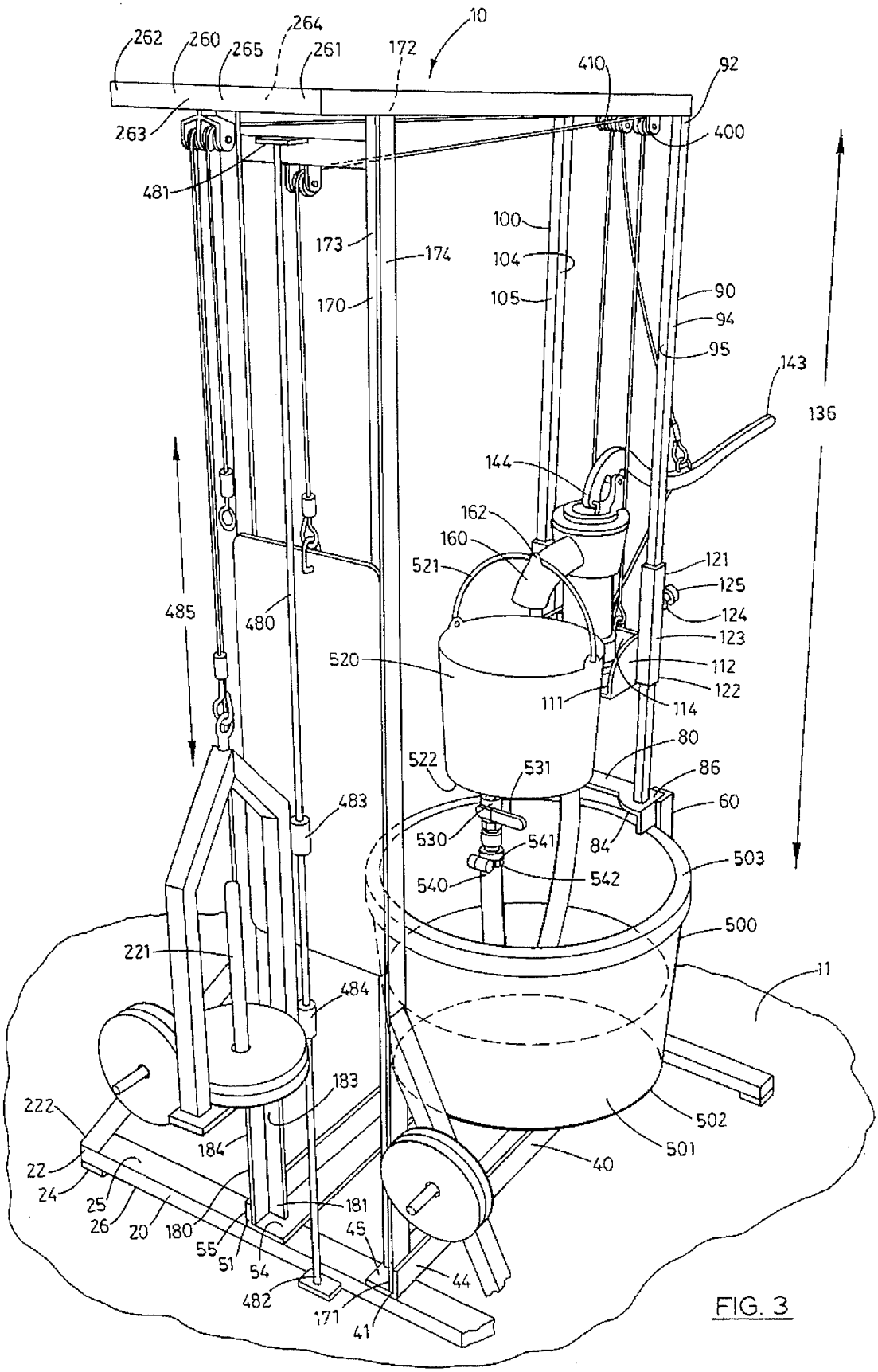
FIG. 3 is a third, perspective, side elevation view of the exercise device of the present invention.

As can be seen by reference to FIGS. 1 and 3, the frame 12, of the exercise device 10, has a first portion 13 and a second portion 14. The first portion 13 rests on the supporting surface 11. The second portion 14 extends upwardly from the first portion 13. The frame 12 has a plurality of structural parts including a first support 20 having a first end 21, and a second or opposite end 22. At the first end 21 of the first support 20 is a first spacer 23 which contacts the supporting surface 11. At the second end 22 of the first support 20 is a second spacer 24 which contacts the supporting surface 11. The spacers 23 and 24 maintain the first support in an elevated position relative to the supporting surface 11. The first support 20 also has an upwardly facing surface 25, and an opposite, downwardly facing surface 26. The first support 20, and most of the remaining parts of the frame described below, may be made from material such as metal tubing, angle iron, or the like. As will be appreciated, any rigid materials suitable for use in a weight-supporting frame may be used for the parts described herein.

Opposite the first support 20, and disposed in an orientation which is substantially parallel to it, is a second support 30. The second support similarly has a first end 31 and a second or opposite end 32. At the first end 31 of the second support 30, is a first spacer 33 which contacts the supporting surface 11. At the second end 32 of the second support 30 is a second spacer 34 which contacts the supporting surface 11. The spacers 33 and 34 maintain the second support 30 in an elevated position relative to the supporting surface 11. The second support 30 also has an upwardly facing surface 35 and an opposite, downwardly facing surface 36.

Mounted on the first and second supports 20 and 30 is a third support 40. The third support 40, as well as the rest of the structural parts of the frame 12, may be mounted on the first and second support members by any suitable fastening technique such as by welding, or using a fastener such as a bolt. The third support 40 has a first end 41, an opposite second end 42, an outwardly facing surface 44, and an opposite inwardly facing surface 45. The outwardly facing surface 44 is mounted on the upwardly facing surfaces 25 and 35 of the first support 20 and the second support 30, respectively.

Also mounted on the first and second support members 20 and 30 is a fourth support 50. The fourth support 50 has a first end 51, an opposite second 52, an inwardly facing surface 54, and an opposite outwardly facing surface 55. The outwardly facing surface 55 is mounted on the upwardly facing surfaces 25 and 35 respectively of the first support 20, and the second support 30, respectively. The third support 40 and the fourth support 50 are disposed in substantially parallel relation one to the other.

Mounted on the third support 40 is a first vertical post 60. The first vertical post 60 has a first end portion 61, and an opposite second end portion 62. A castor 63 is mounted on the second end portion 62 of the first vertical post 60. The first vertical post 60 has an outwardly facing surface 64, and an opposite, inwardly facing surface (not shown). Mounted on the fourth support member 50 is a second vertical post 70. The second vertical post 70 has a first end portion 71, and an opposite, second end portion 72. A castor 73 is mounted on the second end portion 72 of the second vertical post 70. The second vertical post 70 similarly has an outwardly facing surface 74 and an opposite, inwardly facing surface 75. The castors 63 and 73 provide a means by which the frame 12 may be easily propelled or moved across the supporting surface 11.

Figure 2:
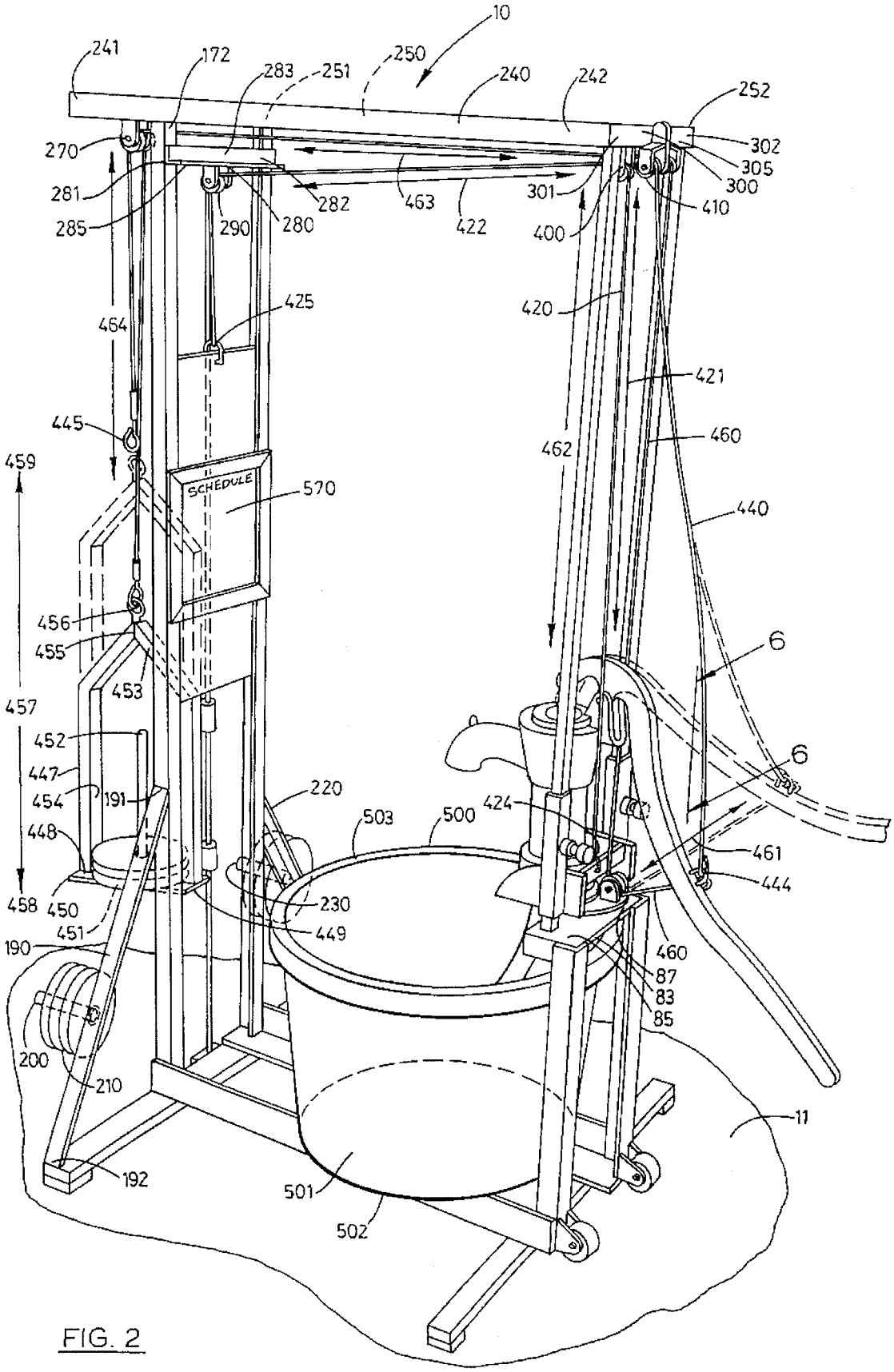
FIG. 2 is a second, perspective, front elevation view of the exercise device of the present invention, and showing the pump handle in solid lines in a first, lowered position, and in phantom lines in a second raised position.

Referring now to FIGS. 1 and 2, mounted between the first vertical post 60 and the second vertical post 70 is a substantially horizontally oriented plate 80. The plate 80 has a first end 81, and an opposite second end 82. The first end 81 is mounted on the inwardly facing surface (not shown) of the first vertical post 60, and the second end 82, is mounted on the inwardly facing surface 75 of the second vertical post 70. The plate 80 has a first edge 83, an opposite second edge 84, and a top surface 85. The plate further has a proximal portion 86, and a distal portion 87.

Figure 4:
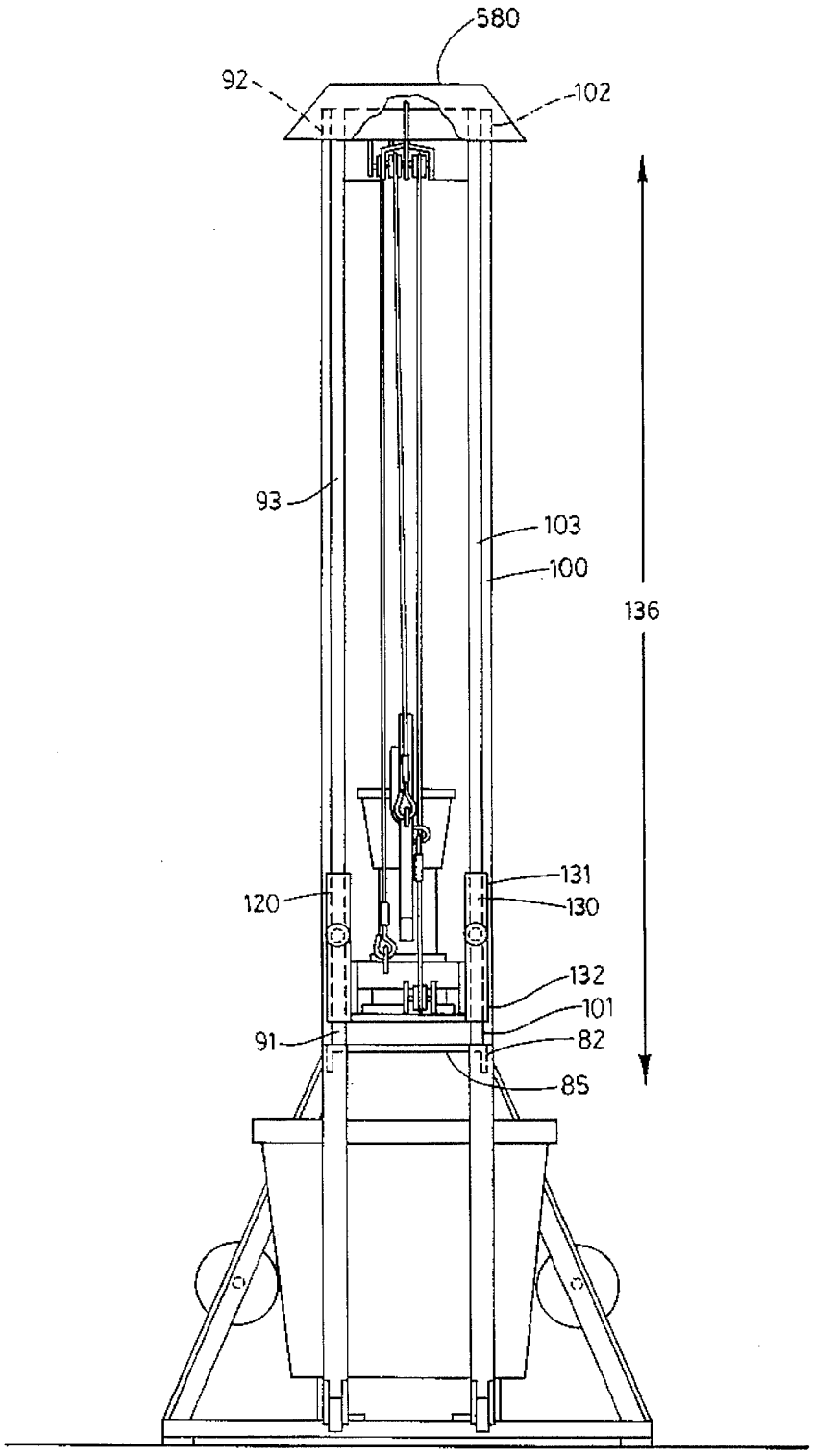
FIG. 4 is side elevation view of the exercise device of the present invention.

As can be seen by reference to FIGS. 1 and 3, a first rail 90 is mounted on the proximal portion 86 of the top surface 85. The first rail 90 has a first end 91, and a second or opposite end 92. As can be seen by further reference to Figure 7, the first rail 90 also has a first surface 93, a second surface 94, a third surface 95, and a fourth surface 96. As can be seen most clearly by reference to FIG. 3, 4, and 7, a second rail 100 is mounted on the distal portion 87 of the top surface 85. The second rail has a first end 101, and a second end 102. The second rail also has a first surface 103, a second surface 104, a third surface 105, and a fourth surface 106. The rails 90 and 100 are mounted on the top surface 85 of the horizontal plate 80 so that they are spaced apart a given distance and oriented in substantially parallel relation one to the other.

Referring now to FIGS. 1 and 3, a support platform 110 is slidably borne by the rails 90 and 100 on the surfaces 93, 94, 95, and 96, and 103, 104, 105, and 106. The support platform 110 includes a pump shelf 111 having a first vertical wall 112; an opposite second vertical wall 113; and a third vertical wall 114, which is oriented between the first and second vertical walls 112 and 113 respectively. Mounted on the support platform 110 is a first single pulley 115.

The support platform 110 telescopingly receives the individual rails 90 and 100 through two individual rail guides 120 and 130. The rail guide 120 is a rectangularly-shaped tube having a first end 121, a second end 122, and a vertically oriented, four-sided wall 123. The wall 123 has a horizontally oriented bore 124 with a given cross sectional dimension. The bore 124 is adapted to receive a pin or bolt 125 which is operable to move into a position where it makes frictional contact with the first surface 93 of the rail 90. Similarly the rail guide 130 has a first end 131, a second end 132, and a vertically oriented, four-sided wall 133. The wall 133 has a horizontally oriented bore 134 with a given cross sectional dimension. The bore 134 is also adapted to receive a pin or bolt 135 which is operable to move into a position where it makes frictional contact with the first surface 103 of the second rail 100. As will be apparent, the bolts 124 and 134 operating in combination with the individual rail guides 90 and 100, form a locking mechanism. The significance of this locking mechanism will be discussed in greater detail hereinafter.

The support platform 110 is movable in a substantially vertical path of travel 136 along the individual rails 90 and 100 respectively. As should be understood, by frictionally disengaging the bolts 124 and 134 from the surfaces 93 and 103, the support platform 110 may be moved along the substantially vertical path of travel 136 and positioned at any desired orientation or position on the frame 12. Further, by frictionally engaging bolts 124 and 134 relative to the surfaces 93 and 103 the support platform 110 may be secured in the desired orientation.

A pump 140 is borne by the pump shelf 111 and is movable with the pump shelf 111 along the substantially vertical path of travel 136. As will be recognized, the pump 140 is slidably borne by the frame 12. The pump 140 is operable to pump a fluid, such as water. The pump includes a main body 141, and an arm or handle 142. The handle has a first end 143, and an opposite second end 144 which is mounted on the main body 141 of the pump 140. The handle 142 has a top side, or edge 145, an opposite bottom side or edge 146, a first lateral side 147, and an opposite, second lateral surface 148. The arm or handle 142 of the pump 140 may be shaped or extended, depending upon the ergonomic demands of the particular exercise to be performed by a patient using the exercise device 10. The handle 142 is reciprocally movable along an arcuately shaped path of travel 149 from a first, or fluid withdrawing position 150, to a second, or fluid exhausting position 151. As should be understood, there is a first predetermined amount of resistance which is experienced in moving the handle 142 from the fluid withdrawing position 150, to the fluid exhausting position 151. Further, there is a second predetermined amount of resistance in moving the handle 142 from the fluid exhausting position 151 to the fluid withdrawing position 150. In the preferred embodiment, the pump 140 is a cistern pump of substantially conventional design, and therefore for purposes of brevity the specifics of the pump's construction are not discussed in any significant detail.

Figure 6:
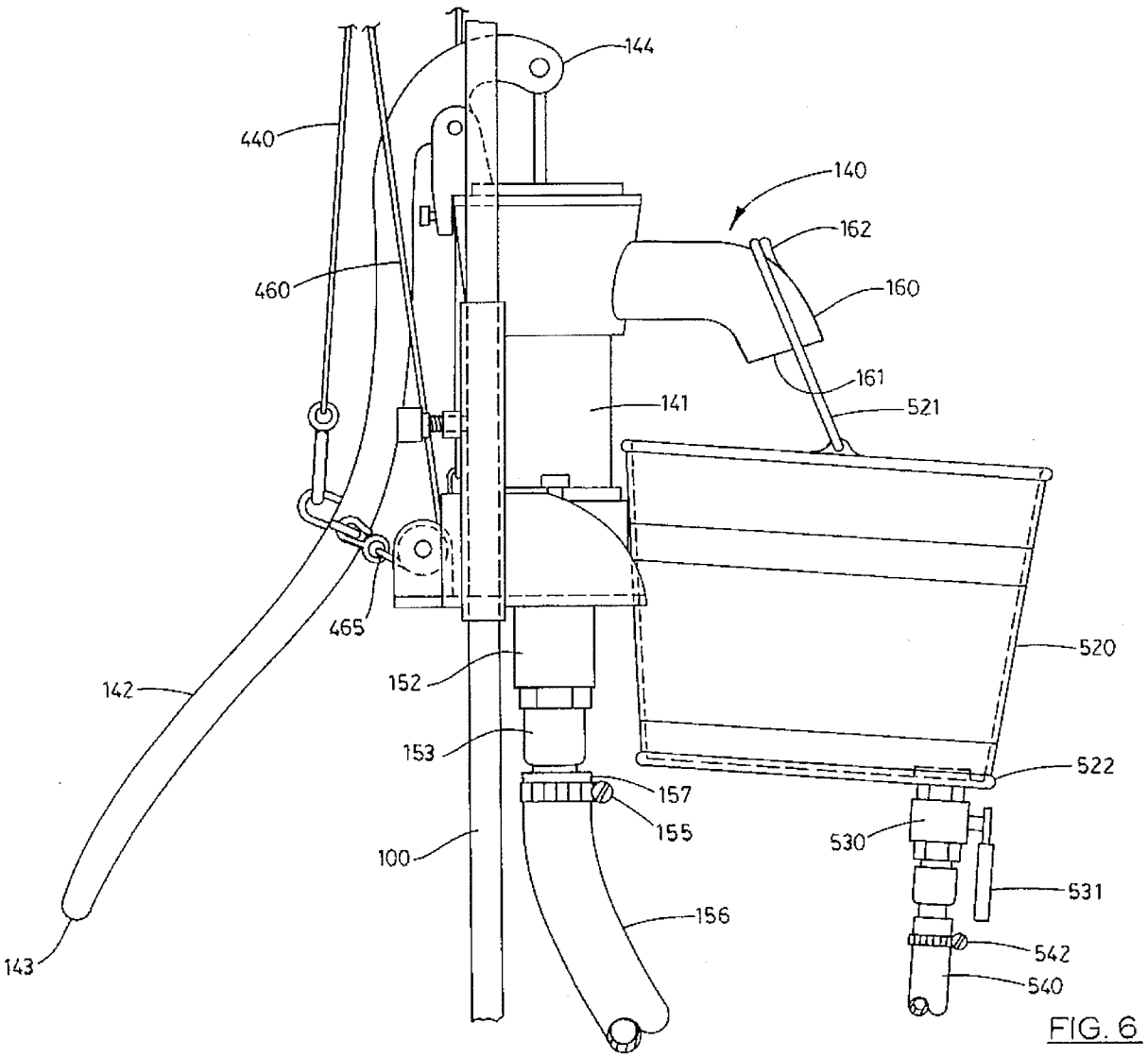
FIG. 6 is a fragmentary, enlarged, side elevation view of the pump and handle of the exercise device of the present invention and taken from a position along line 6—6 of FIG. 2.

As can be best seen by reference to FIG. 6, connected on the main body 141 of the pump 140 is a check valve 152. The check valve receives a first threaded tube (not shown) which is mounted on the main body 141 of the pump 140. A second threaded tube 153 is received in the check valve 152. The check valve 152 permits liquid to flow into the main body 141 of the pump 140 while preventing liquid from flowing out of the main body 141. Connected on the second threaded tube 153 by means, for example, of a clamp 155 is a first fluid tube or conduit 156. The conduit has a first end 157, and a second or opposite end (not shown). The first end 156 of the first conduit 155 is disposed in fluid flowing relation relative to the main body 141. Additionally, and connected to the main body 141, of the pump 140, is an exhaust pipe 160 which has an exhaust opening 161 and a protrusion 162.

Referring now to FIGS. 1, 2, and 3, a third vertical post 170 and a fourth vertical post 180 are mounted on the third and fourth supports 40 and 50 respectively, and are further oriented substantially vertically and perpendicular relative thereto. The third vertical post has a first end portion 171, a second end portion 172, an inwardly facing surface 173, and an opposite, outwardly facing surface 174. The outwardly facing surface 174 of the first end portion 171 is mounted on the inwardly facing surface 45 of the third support 40.

The fourth vertical post 180 has a first end or portion 181, an opposite second end, or portion 182, an inwardly facing surface 183, and an opposite, outwardly facing surface 184. The outwardly facing surface 184 of the first end portion 181 is mounted on the inwardly facing surface 54 of the fourth support member 50.

Mounted on the upwardly facing surface 25 of the first support member 20, and the outwardly facing surface 174 of the third vertical post 170 is a first brace 190. The first brace 190 has a first end 191, which is mounted on the third vertical post 180, and a second end 192, which is mounted on the first support member 20. Mounted on the first brace 190 is a first rod or post 200. The rod 200 slidably receives a plurality of discrete weights 210. Mounted on the upwardly facing surface 35 of the second support member 30 and the outwardly facing surface 184 of the fourth vertical post 180 is a second brace 220. The second brace 220 has a first end 221 which is fastened on the fourth vertical post 180, and a second end 222 which is fastened on the first support member 20. Mounted on the second brace 220 is a second rod or post 230. The second rod 230 is similarly operable to slidably receive the discrete weights 210.

Figure 7:
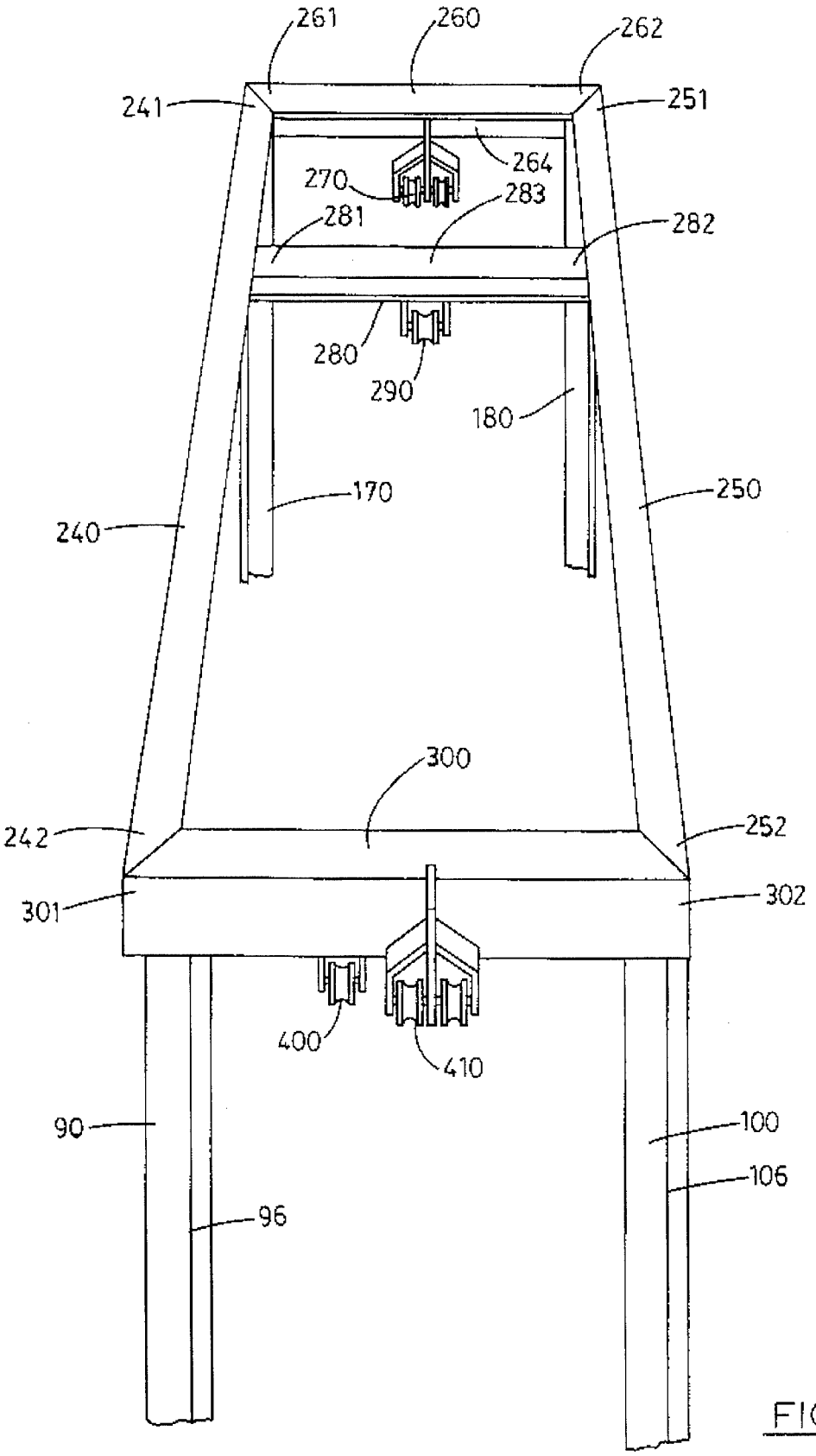
FIG. 7 is a fragmentary, perspective, top plan view of the exercise device of the present invention.

As can be best seen by reference to FIGS. 1, 3, and 7, mounted between the third vertical post 170 and the first rail 90 is a first horizontally oriented beam 240. The first beam 240 has first end 241, and an opposite or second end 242. Further, mounted between the fourth vertical post 180, and the second rail 100 is a second horizontally oriented beam 250. The second beam 250 has a first end 251, and a second end 252.

A first crosspiece or brace 260 having a first end 261, an opposite second end 262, and a middle portion 263 is mounted between the first horizontally oriented beam 240, and the second horizontally oriented beam 250. The first end 261, of the crosspiece or brace 260 is fastened on the first end 241 of the first beam 240. Further, the second end 262 of the crosspiece or brace 260 is fastened on the first end 251 of the second beam 250. The crosspiece or brace 260 has an inwardly facing surface 264 and an opposite or outwardly facing surface 265. Mounted on the outwardly facing surface 265 of the middle portion 263 is a first, dual pulley 270.

A second crosspiece or brace 280 having a first end 281, an opposite second end 282, and a middle portion 283 is mounted between the third vertical post 170, and the fourth vertical post 180. The first end 281 of the second crosspiece or brace 280 is mounted proximal to the second end 172 of the third vertical post, and the second end 282 of the second crosspiece or brace 280 is mounted proximal to the second end 182 of the fourth vertical post 180. The second crosspiece or brace 280 has an inwardly facing surface 284, and an outwardly facing surface 285. Mounted on the outwardly facing surface 285 of the middle portion 283 is a second, single pulley 290.

A third crosspiece or brace 300 having a first end 301, an opposite second end 302, and a middle portion 303 is mounted between the first horizontally oriented beam 240, and the second horizontally oriented beam 250. The first end 301 of the third crosspiece or brace 300 is mounted on the second end 92 of the first rail. Further, the second end 302 of the third crosspiece or brace 300 is mounted on the second end 102, of the second rail 100. The third crosspiece or brace 300 has an inwardly facing surface (not shown), and an outwardly facing surface 305. Mounted on the inwardly facing surface of the middle portion 303 of the crosspiece or brace 300 is a third single pulley 400. Further, mounted on the outwardly facing surface 305 of the middle portion 303 of the crosspiece or brace 300, is a second dual pulley 410.

Referring now to FIGS. 1, 2, and 3, routed or otherwise directed over the second single pulley 290, and the third single pulley 400, is a first cable 420. The first cable 420 travels or otherwise moves over a first vertical course 421; an angular course 422; and a second vertical course 423. The first cable 420 has a first end 424, and an opposite second end 425. The first end 424 of the first cable 420 is affixed on the side 114 of the support platform 110. The second end 425 of the cable 420 is affixed on a flat weight 430. The flat weight 430 has a first end 431 and a second or opposite end 432. The flat weight is positioned between the third vertical post 170 and the fourth vertical post 180 and is thus guided thereby along a predetermined path of travel. As should be understood, the pulleys 290 and 400, first cable 420, support platform 110, and flat weight 430 combine together to form a counter-balancing mechanism. The counter-balancing mechanism is coupled in force transmitting relation relative to the pump 140.

Routed or otherwise directed over the first double pulley 270, and the second dual pulley 410 is a second cable 440. The second cable 440 travels or moves over or along a vertical course 441, a horizontal course 442, and an angular course 443. The second cable 440 has a first end 444, and an opposite second end 445. The first end 444 of the second cable 440 is affixed on the top edge 145 of the handle 142. The second end 445 is releasably affixed to a platform 447.

The platform 447 includes a horizontally oriented bar 448 which has a first end 449; a second or opposite end 450; and a middle portion 451. Mounted on the middle portion 451 of the bar 448 is a vertically oriented rod 452. Further, mounted on the first end 449 is a first angled post 453, and mounted on the second end 449 is a second angled post 454. The first angled post 453, and the second angled post 454 meet at a juncture or apex 455 where a loop 456 is affixed. As will be seen from the drawing, the platform moves in a relatively vertically oriented path of travel 457 from a first or lower position 458, to a second or higher position 459.

Routed or otherwise directed under the first single pulley 115, over the second dual pulley 410, and onto the first dual pulley 270 is a third cable 460. The third cable 460 travels over or moves along an angular course 461, a first vertical course 462, a horizontal course 463, and a second vertical course 464. The third cable 460 has a first end 465, (shown in FIG. 6), which is releasably affixed on either the bottom edge 146, or the first lateral side 147 of the pump handle 142. The third cable 460 also has a second end 466, which is releasably affixed on the platform 447. As should be understood, the double pulleys 270 and 410, single pulley 115, second cable 440, third cable 460, platform 447, and discrete weights 210 combine together to form a work-adjusting mechanism.

While the work-adjusting mechanism of the present invention is preferably a pulley and cable system, a variety of devices could be coupled in force transmitting relation relative to the pump handle 142 to provide the desired level of work adjustment. For example, hydraulic or pneumatic cylinders, elastic bands, or springs could be coupled to the handle 142 to provide the given work adjustment. In addition, the pulley and cable system could be replaced by other means to couple the weights 210 in force transmitting relation relative to the handle 142.

As can be best seen by reference to FIG. 3, and as an optional feature of the present invention, a guide rod 480 may be connected on the frame 12. The guide rod 480 has a top end 481, and an opposite bottom end 482. The top end 481 is mounted on the cross piece or brace 260, and the bottom end 482 is mounted on the first support member 20. The platform 447 is slidably mounted on the platform guide 480 by means of a first cylinder 483, and a second cylinder 484. The cylinders 483 and 484 are adapted to receive the guide rod 480. The guide rod 480 limits the horizontal movement or swinging of the platform 447 so that it moves relatively smoothly up, and down, in a linear, substantially vertical path of travel 485.

In addition to the structural parts of the frame 12, the locking mechanism, the counter-balancing mechanism, and the work-adjusting mechanism described above, the present invention also includes a fluid reservoir 500. The fluid reservoir 500 is removably positioned on top of the third and forth supports 40 and 50 respectively. The reservoir 500 has a cylindrically shaped side wall 501, a bottom surface 502, and a top peripheral edge 503. The reservoir may be any container which is capable of holding a fluid, but it is preferable that the container be lightweight, and corrosion resistant. While the present invention has been described as having a reservoir, it is possible that a fluid could be supplied directly to the pump by means, for example, of a pipe, and that fluid exhausted from the pump could be directed to, for example, a drain.

The present invention may also include a container or bucket 520. The bucket 520 has a handle 521 which may be positioned in movement impeding relation behind the protrusion 162 on the exhaust pipe 160 in order to secure the handle 521 on the exhaust pipe 160 and suspend the bucket 520 in a fluid receiving orientation relative to the exhaust pipe 160. The bucket 520 also has a bottom surface 522 and an opening or aperture (not shown) in the bottom surface 522. Connected in fluid flowing relation relative to the bucket 520 is a fluid release mechanism 530. The fluid release mechanism 530 includes a handle 531. Connected in fluid discharging relation relative to the release mechanism 531 is a second fluid tube 540. The second fluid tube 540 has a first end 541 which is affixed on the release mechanism, by means of, for example, clamp 542, and a second end (not shown) which is positioned within the fluid reservoir 520.

As shown in FIG. 2, a progress display assembly 570 may be mounted on the frame 12 of the exercise device 10. In particular, such an assembly could be mounted on the third and fourth vertical posts 170 and 180. The progress display assembly 570 may be, for example, a chalkboard or electronic display. The assembly 570 may be used for example, to record the amount of fluid pumped by a patient during a given exercise period.

Figure 5:
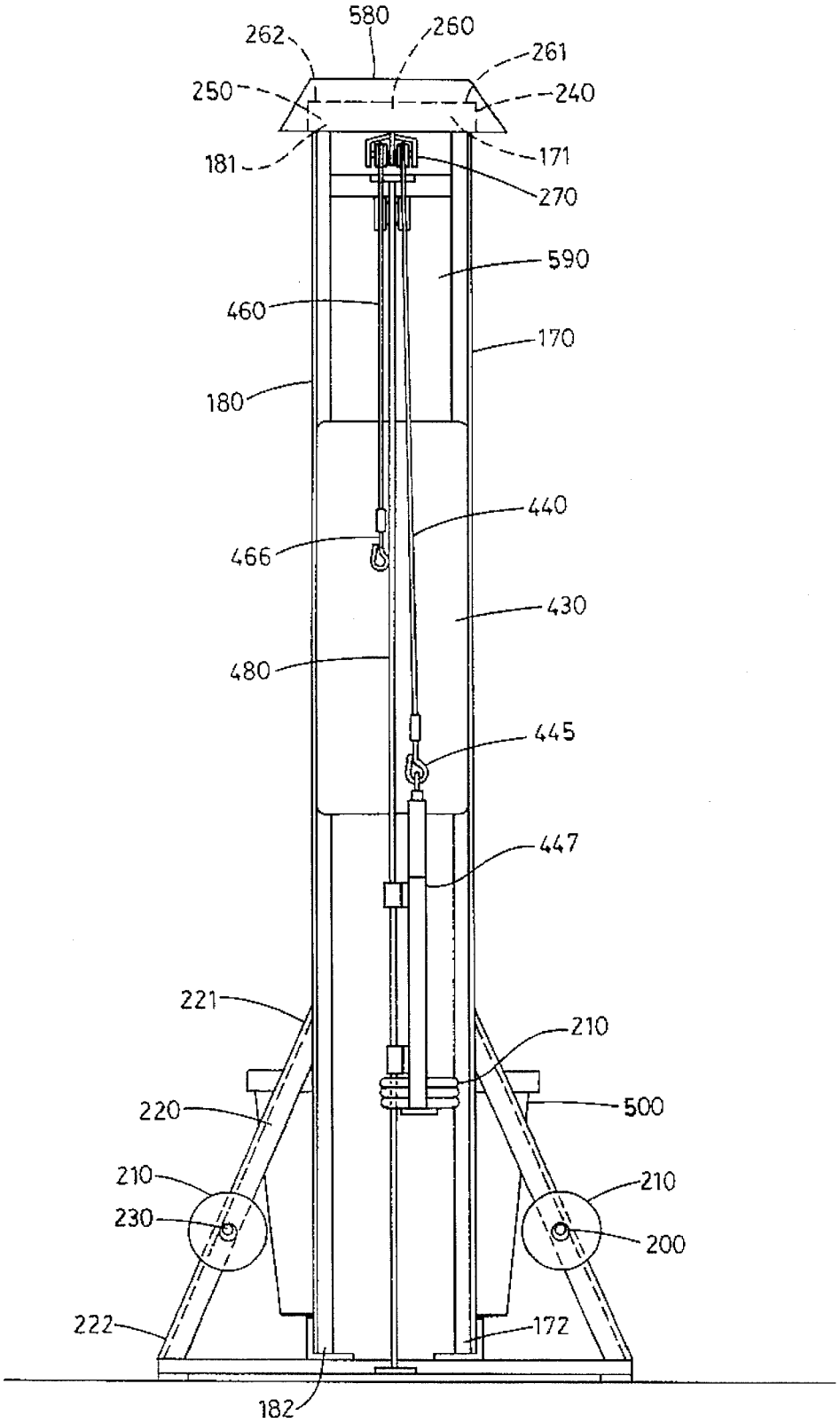
FIG. 5 is a side elevation view of the exercise device of the present invention opposite to that which is shown in FIG. 4.

As best seen in FIG. 5, and as another feature of the present invention, aesthetic coverings may also be mounted on the frame 12. For example, the exercise device may include a covering top 580 and a backboard 590.

OPERATION

The operation of the present invention is believed to be readily apparent but is briefly summarized below.

The purposeful exercise device 10 of the present invention is operable to be pumped by an operator or patient (not shown). As can best be imagined by a study of FIG. 1, the patient is positioned so that he or she may manually operate the pump 140 by moving the handle 142. The pump 140 is operable to pump a fluid from the reservoir 500 through the first fluid tube 156, into the main body 141 of the pump 140, through the exhaust pipe 160, and out the exhaust opening 161 back to the reservoir 500. As was earlier discussed, the fluid tube 156 provides a conduit for fluid to be withdrawn from the fluid reservoir 500 into the pump 140. In this regard, the first end of the fluid tube 156 is disposed in fluid transmitting relation relative to the pump 140 and the second end of the fluid tube (not shown) is oriented in fluid withdrawing relation relative to the reservoir 500. Fluid from the reservoir circulates in a path indicated by the curved line 600 shown in FIG. 1. Accordingly, the exercise device 10 is operable to provide a purposeful activity of pumping a fluid for a patient undergoing occupational therapy and rehabilitation.

In addition, the exercise device 10 may be used to provide patients with the purposeful exercise of filling the bucket 520 with fluid. When the bucket 520 is suspended from the exhaust pipe 160, the fluid is pumped through the pump 140 and is exhausted from the exhaust pipe 160, thereby filling the bucket 520. As should be understood, the fluid may continue to be pumped until the bucket 520 is full. When this occurs the fluid is released back to the fluid reservoir 500 by means of the second fluid tube 540 by opening the release mechanism 530 by the handle 531.

The therapeutic effect of the purposeful exercise provided by the present invention may be enhanced by adding resistance to that encountered by a patient moving the handle 142 from the fluid withdrawing position 150 to the fluid exhausting position 151. This resistance may be adjusted by means of the work-adjustment mechanism. In the preferred embodiment, the work-adjustment mechanism includes the dual pulleys 270 and 410, the first single pulley 115, the second cable 440, and the third cable 460.

During use, and as can be seen by reference to FIG. 1, the second cable 440 may be affixed to the loop 456 of the platform 447. A predetermined number of discrete weights 210 may then be placed on the horizontal bar 448. By means of gravity, the platform is forced to the first lowermost position 458, and the handle 142 is forced to the fluid withdrawing position 150.

When the handle 142 is moved from the fluid withdrawing position 150, to the fluid exhausting position 151, the cable 440 moves up through the vertical course 464, from left to right across the horizontal course 463, and down through the angular course 462. When this occurs, the patient encounters a resistance to moving the handle 142 that includes the first predetermined resistance to moving the handle 142 plus the resistance, as transmitted by the work-adjustment mechanism to the handle 142. This resistance includes the predetermined number of the discrete weights 210, which are urged from the first lowermost position 458, to the second uppermost position 459.

As can be seen by reference to FIG. 2, the third cable 460 may be alternatively affixed to the loop 456, of the platform 447. In this situation, a predetermined number of discrete weights 210 may be placed on the horizontal bar 448. By means of gravity the platform is forced to the first or lowermost position 458 and the handle 142 is forced to the fluid exhausting position 151.

When in the situation immediately described above, and moving the handle 142 from the fluid exhausting position 151, to the fluid withdrawing position 150, the third cable moves up the angular course 461, down the vertical course 462, in a direction from left to right across the horizontal course 463, and then up the vertical course 464. In this configuration, the patient encounters a resistance to moving the handle that includes the second predetermined resistance of moving the handle 142, plus the resistance, as transmitted by the work-adjustment mechanism to the handle 142, of moving the platform 450, which is carrying a predetermined number of discrete weights 210, from the first or lowermost position 458, to the second or uppermost position 459.

To further enhance the usefulness of the present invention, and as was discussed earlier, the height of the pump 140 and, therefore, the height of the pump handle 142 in relation to the patient or operator performing exercises with the exercise device 10 may be adjusted. In this regard the pump 140, is slidably or adjustably borne by the frame 12. To facilitate the movement of the pump 140 along the rails 90 and 100, the support platform 110 which bears the pump 140 is coupled in force transmitting relation to the flat weight 430 by means of the first cable 420. In particular, when the pump 140 is moved in a vertical direction towards the second portion 14 of the frame 12, the first cable 420 in response moves along the first vertical course 421, in a direction from right to left over the angular course 422, and along the second vertical course 423. When the pump 140 is moved down towards the first portion 13 of the frame 12, the first cable 420 in response moves down, over the first vertical course 421, in a direction from left to right over the angular course 422, and up the second vertical course 423. As should be understood, the mass of the flat weight 430 is roughly equal to the mass of the pump 140 and the support platform 110 combined. Accordingly, when the bolts 124 and 134 are disengaged from the surfaces 93 and 103, the movement of the pump 140 along its respective course of travel is substantially effortless.

The purposeful exercise device 10 of the present invention is designed mainly for use as a rehabilitation device, though many other uses are conceivable such as a home exercise machine, fitness center, exercise machine, motor assessment device, etc. When used for rehabilitation purposes, the exercise device of the present invention provides, in summary, exercises for major muscle groups important in ambulating with a walker or cane, rising from or propelling a wheelchair, or for using railings or grab bars for mobility and safety. The main upper extremity muscle groups involved in the above-listed activities are shoulder and elbow flexors and extensors, and shoulder adductors and abductors. These muscles are distal muscles, and when they are called upon to perform, proximal muscles, i.e., muscles in the trunk and back, are called upon to stabilize the body. The amount of stabilization required depends upon a person's or patient's biomechanical position relative to the exercise device 10. More specifically, the amount of stabilization provided by proximal muscles depends on whether the patient is standing or sitting while moving the pump handle 142. Proximal muscles may be more vigorously exercised if the patient stands or sits in a position where his or her upper body is unsupported while moving the pump handle 142. The height of the pump 140 in relation to a patient is adjustable for this purpose and may be selectively adjusted so that a patient may stand while exercising, thus affording an activity that requires standing tolerance and balance.

There are, of course, various rehabilitating and strengthening exercises which can be performed by using the exercise device 10. For example, the exercise device 10 can be used to perform exercises which strengthen shoulder flexors and elbow extensors. To properly perform such an exercise, a patient should be placed next to the handle 142 so that the arc of the handle 142 is forward of the patient's shoulder. The patient then reciprocally moves the handle 16 from the fluid withdrawing position 150, to the fluid exhausting position 151, and vice versa. As described above, additional resistance to this motion may be added by placing weights 210 on the platform 447 and affixing the second cable 440 on the platform 447. The extra resistance is encountered by the patient as he or she pushes the handle 142 down. To strengthen shoulder extensors and elbow flexors, the patient should be positioned as previously described, and the third cable 460 should be connected to the platform 447. Another exercise that can be executed using the device of the present invention strengthens shoulder abductors and adductors. In this exercise, the patient should be placed beside the handle so that the patient's shoulder is just above their hand when the pump handle is in the middle of its arc. To strengthen proximal trunk muscles, the exercise as described above may be carried on while the patient is standing or while the patient is seated, but without support for the upper body.

Additionally, the exercise device of the present invention may be used to increase endurance and stamina. Individuals lacking stamina and endurance need to engage in activities that can, at first, be easily performed so as to slowly build up their stamina and endurance. Accordingly, the pump handle 142 can be easily pumped in order to provide a relatively low resistance exercise. However, further resistance to moving the handle of the pump may be added, as was described above, by means of the work-adjustment mechanism. Thus, a patient may begin rehabilitation at a low intensity level, and increase his or her activity to higher intensity levels. Further, patients may use the present invention to increase endurance and stamina by setting goals to pump a predetermined amount of fluid in a given amount of time. A patient might, for example, attempt to fill a certain number of buckets with fluid in a predetermined amount of time. For example, an initial goal for a patient might be to pump five gallons of fluid in a ten minute period. The amount of water pumped or number of buckets filled may then be recorded on the progress display assembly.

Thus, the present invention provides a purposeful exercise device which uses a relatively inexpensive and reusable material, that is, water. The apparatus further provides a purposeful activity without producing any byproducts, provides exercise and rehabilitation for the shoulder, elbow, and arms of a patient, as well as exercise for the muscles of the trunk and back. Lastly, the exercise device of the present invention provides a purposeful activity which is measurable so that the progress the patient makes may be recorded.

Having described my invention, what I claim as new and desire to secure by Letters Patent of the United States is:

1. An exercise device for use by an operator, the device comprising:

a frame;

a pump mounted on the frame, and wherein the fluid dispensing pump includes a handle for manually operating the pump, and wherein the handle is movable along a path of travel from a first upper position to a second second position; and a work-adjusting mechanism comprising weight means movably borne by the frame and in force transmitting relation to the pump for selectively adjusting the amount of work performed by the operator when moving the pump handle from the first position to the second position.

2. The exercise device as claimed in claim 1, and wherein the pump is movable along a predetermined path of travel relative to the frame, and wherein a locking mechanism selectively secures the pump in a predetermined position relative to the frame.

3. The exercise device as claimed in claim 2, and wherein the pump moves along a substantially linear path of travel, and wherein the exercise device includes a counter-balancing mechanism which is borne by the frame, and connected in force transmitting relation relative to the pump, the counter balancing mechanism facilitating movement of the pump along the linear path of travel.

4. The exercise device as claimed in claim 3, and further including a fluid reservoir, and a fluid tube having first and second ends, and wherein the first end of the fluid tube is connected in fluid transmitting relation relative to the pump, and the second end of the fluid tube is positioned in fluid withdrawing relation relative to the fluid reservoir.

5. The exercise device as claimed in claim 4, and wherein a pulley is borne by the frame and the work-adjusting mechanism includes a platform which is operable to selectively receive a plurality of individually discrete weights, and wherein a cable is affixed on the platform, routed over the pulley and affixed to the pump handle.

6. The exercise device as claimed in claim 5, and wherein a pulley is borne by the frame and a cable is affixed on the counter-balancing mechanism, routed over the pulley, and is connected on the main body of the pump.

7. The exercise device as claimed in claim 6, and wherein the pump handle moves along an arcuately shaped path of travel from the first position, wherein the pump is operable to withdraw fluid from the reservoir, to the second position wherein the pump is operable to exhaust fluid back to the reservoir, and wherein the cable affixed on the platform is selectively affixed on the handle so as to provide resistance, as desired by the operator, upon movement of the handle along the arcuately shaped path of travel.

8. The exercise device as claimed in claim 7, and further comprising a progress display assembly mounted on the frame.

9. An exercise device comprising:

a frame having a first portion which is capable of resting on a supporting surface and a second portion mounted thereto;

a pump slidably borne by the second portion of the frame and wherein the pump includes a main body, a handle for manually operating the pump, and a locking mechanism for selectively securing the pump in a predetermined orientation on the second portion of the frame, and wherein the handle is movable along an arcuately shaped path of travel from a first position to a second position;

a counter-balancing mechanism movably borne by the second portion of the frame;

a counter-balancing mechanism pulley system borne by the second portion of the frame and which includes a pulley, and a cable routed through the pulley, and wherein the cable has a first end connected on the main body of the pump, and a second end connected on the counter-balancing mechanism;

a work-adjusting mechanism comprising weight means movably borne by the second portion of the frame; and a work-adjusting pulley system borne by the second portion of the frame and which includes a work-adjusting pulley, and a work-adjusting cable operating in combination with the work-adjusting pulley, the work-adjusting cable having a first end connected on the pump handle, and a second end affixed on the work-adjusting mechanism.

10. The exercise device as claimed in claim 9, and further including a fluid reservoir borne by the frame, and a fluid tube having a first end disposed in fluid discharging relation to the pump, and a second end disposed in fluid withdrawing relation to the reservoir.

11. The exercise device as claimed in claim 10, and wherein the work-adjusting mechanism includes a platform which is operable to selectively receive discrete weights.

12. The exercise device as claimed in claim 11, and further including a guide borne by the second portion of the frame, and wherein the platform is slidably mounted on the guide and is directed along a predetermined path of travel relative to the frame.

13. The exercise device as claimed in claim 12, and wherein the pump is a cistern-type pump which is operable to withdraw fluid from the reservoir when the handle is placed in the first position, and to exhaust the fluid back to the reservoir when oriented in the second position.

14. The exercise device as claimed in claim 13, and wherein the work-adjusting cable is selectively affixed on the handle in a predetermined fashion whereby resistance can be selectively applied to the handle as the handle moves along the arcuately shaped path of travel.

15. The exercise device as claimed in claim 14, and further including a progress display assembly which is mounted on the frame.

16. An exercise device for use by an operator, the device comprising:

a frame which is capable of resting on a supporting surface;

a fluid dispensing pump slidably borne by the frame, and wherein the pump has a main body, a locking mechanism for selectively securing the pump in a predetermined orientation on the frame, and a handle for manually operating the pump; and a counter-balancing mechanism comprising weight means borne by the frame and disposed in force transmitting relation relative to the pump thereby facilitating the adjustable orientation of the pump relative to the frame.

17. The exercise device as claimed in claim 16, and wherein the handle is reciprocally movable along an arcuately-shaped path of travel from a first position, to a second position, thereby defining a predetermined intake and exhaust strokes, and wherein a first predetermined amount of work is performed during the intake stroke, and a second predetermined amount of work is performed during the exhaust stroke.

18. The exercise device as claimed in claim 17, and further including a work-adjusting mechanism movably borne by the frame and disposed in force transmitting relation relative to the pump handle for selectively changing the amount of work performed by the operator during the intake or exhaust strokes.

19. An exercise device for providing purposeful activity to a patient undergoing occupational therapy, the exercise assembly comprising:

a reservoir enclosing a source of fluid;

a pump having a handle, and wherein the handle is movable from a fluid withdrawing position to a fluid exhausting position thereby defining a path of travel; and a work-adjusting mechanism mechanism disposed in force transmitting relation relative to the handle, and wherein the work adjusting mechanism selectively applies resistance to the handle as it moves along the path of travel from the respective first and second positions.

* * * * *